US007344001B2

(12) United States Patent
Inoue et al.

(10) Patent No.: US 7,344,001 B2
(45) Date of Patent: Mar. 18, 2008

(54) SPEAKER DIAPHRAGM AND SPEAKER STRUCTURE

(75) Inventors: Toshihide Inoue, Neyagawa (JP); Hiroyasu Kumo, Neyagawa (JP)

(73) Assignee: Onkyo Corporation (JP)

( * ) Notice: Subject to any disclaimer, the term of this patent is extended or adjusted under 35 U.S.C. 154(b) by 0 days.

(21) Appl. No.: 11/355,438

(22) Filed: Feb. 16, 2006

(65) Prior Publication Data

US 2006/0266577 A1 Nov. 30, 2006

(30) Foreign Application Priority Data

May 25, 2005 (JP) ..... 2005-152037
Oct. 27, 2005 (JP) ..... 2005-312107

(51) Int. Cl.
*H04R 7/02* (2006.01)
*G10K 13/00* (2006.01)

(52) U.S. Cl. ..... 181/169; 181/167; 381/426; 381/428

(58) Field of Classification Search ..... 181/164, 181/167–170; 381/423, 426, 428, 429
See application file for complete search history.

(56) References Cited

U.S. PATENT DOCUMENTS 2,405,472 A * 8/1946 Norris ..... 367/174
2,900,453 A * 8/1959 Cammack ..... 381/355
3,572,919 A * 3/1971 Hayes ..... 353/15
4,344,503 A * 8/1982 Nakamura et al. ..... 181/170
4,351,412 A * 9/1982 Yamamuro et al. ..... 181/170
4,440,983 A * 4/1984 Facoetti et al. ..... 381/190
4,484,383 A * 11/1984 Takewa et al. ..... 29/896.23
4,639,283 A * 1/1987 Nakamura ..... 156/89.13
5,031,720 A * 7/1991 Ohta et al. ..... 181/169
5,259,036 A * 11/1993 Seeler ..... 381/426
6,378,649 B1 * 4/2002 Inoue et al. ..... 181/167
6,543,573 B2 * 4/2003 Ishihara et al. ..... 181/167
6,591,938 B2 * 7/2003 Inoue et al. ..... 181/167
2002/0100635 A1 8/2002 Inoue
2004/0112672 A1 6/2004 Ono et al.
2006/0137935 A1 * 6/2006 Nevill ..... 181/174

FOREIGN PATENT DOCUMENTS

JP 54087211 A 7/1979
JP 54105525 A * 8/1979
JP 54118234 A * 9/1979
JP 57009194 A * 1/1982
JP 57063996 A * 4/1982
JP 57147398 A * 9/1982
JP 59210791 A 11/1984
JP 61007798 A * 1/1986
JP 03053936 A * 3/1991

(Continued)

*Primary Examiner*—Edgardo San Martin
(74) *Attorney, Agent, or Firm*—The Webb Law Firm, P.C.

(57) ABSTRACT

A speaker diaphragm includes a base material impregnated with a thermosetting resin composition. The base material includes a first surface material, a core material, and a second surface material in the stated order; the first surface material and the second surface material are each formed of a woven fabric or a non-woven fabric; and the core material is formed of a woven fabric or a non-woven fabric each including hollow fine particles.

17 Claims, 5 Drawing Sheets

FOREIGN PATENT DOCUMENTS

| | | | | |
|---|---|---|---|---|
| JP | 04035200 | A | * | 2/1992 |
| JP | 05068297 | A | * | 3/1993 |
| JP | 09084168 | A | * | 3/1997 |
| JP | 11285094 | A | | 10/1999 |
| JP | 2002078076 | A | | 3/2002 |

* cited by examiner

SPEAKER DIAPHRAGM AND SPEAKER STRUCTURE

This application claims priority under 35 U.S.C. Section 119 to Japanese Patent Application No. 2005-152037 filed on May 25, 2005, and to Japanese Patent Application No. 2005-312107 filed on Oct. 27, 2005, which are herein incorporated by reference.

FIELD OF THE INVENTION

The present invention relates to a speaker diaphragm and a speaker structure. More specifically, the present invention relates to a speaker diaphragm having an excellent balance between rigidity and internal loss, and to a lightweight speaker structure having excellent rigidity.

DESCRIPTION OF THE RELATED ART

In general, there are proposed many materials for a speaker diaphragm including a material prepared by sheet making of a short fiber such as pulp, a material prepared by molding a metal thin sheet, and a material prepared through injection molding of a thermoplastic resin such as polypropylene.

In recent years, for a high-power speaker system, a material for a speaker diaphragm is required to have heat resistance and rigidity withstanding heat generated from a coil and a large driving force. Of various diagram materials, a fiber reinforced plastic (FRP) prepared by impregnating a woven fabric or non-woven fabric of a synthetic fiber or a natural fiber with a thermosetting resin such as an epoxy resin or an unsaturated polyester resin and molding the whole has relatively high heat resistance and rigidity, and a diaphragm employing FRP is used heavily. An FRP diaphragm is most generally produced by impregnating a woven fabric of a reinforced fiber such as a carbon fiber or a glass fiber with an epoxy resin as a matrix resin and heat-curing the resin. The FRP diaphragm has sufficiently high elastic modulus, but has extremely small internal loss. As a result, a steep peak generates at a high resonance frequency (Fh), to thereby cause extensive coloring of a tone. Further, the FRP diaphragm requires curing for 10 to 30 minutes and thus has a disadvantage of low productivity.

Examples of an industrial method of molding FRP include sheet molding and bulk molding. However, those methods each involve supply of one molding material at a time and require a curing time of several tens minutes, and thus each have disadvantages of low operability and low productivity.

Meanwhile, there is proposed a diaphragm produced by impregnating a natural fiber such as a silk fiber or a cotton fiber with a highly reactive unsaturated polyester resin and curing the resin (see JP 3137241 B or JP 2004-193716 A, for example). Such a diaphragm has high productivity and moderate internal loss. However, the diaphragm has high density and must have a small thickness for preventing reduction in sound pressure, and thus has a disadvantage of insufficient rigidity.

There is also proposed a diaphragm employing a lightweight and thick foamed thermoplastic resin (see JP 2001-189990 A, for example). The foamed resin has a secured thickness but has disadvantages of low elastic modulus and low bending rigidity. To be specific, the combination of a foamed product as a core material and high-elastic modulus sheets as surface materials bonded to both sides thereof may provide improved rigidity. However, bending rigidity of a multilayer structure varies depending on bonding strength between the core material and each of the surface materials and shear deformation strength of the core material. The foamed product has low shear deformation strength and many hollow parts, and thus has a disadvantage in that sufficient bending rigidity cannot be obtained even if surface materials having high elastic modulus are arranged on both sides thereof.

There is also proposed a diaphragm in which surface materials are bonded through vertical walls (that is, a diaphragm having a honeycomb structure). Such a diaphragm is generally formed of surface materials having high elastic modulus such as metals and vertical walls, and thus has high bending rigidity. However, such a diaphragm has extremely small internal loss, and spaces formed by the walls and the surface materials resonate. Thus, the diaphragm has a disadvantage such as an adverse effect on acoustic characteristics. Further, molding of such a diaphragm involves difficulties.

For a speaker structure such as a speaker frame, a steel sheet, an aluminum sheet, an aluminum die-cast, a thermoplastic resin, or the like is generally used. In recent years, weight reduction of a vehicle speaker, in particular, is required for improving fuel consumption. Thus, weight reduction of a speaker structure accounting for a relatively large ratio of speaker components is required. However, a general steel sheet to be used for the speaker structure has high density. In addition, an aluminum sheet has low rigidity, and thus has a disadvantage of causing deformation and abnormal sound when a speaker structure is clamped for installment. An aluminum die-cast is hardly reduced in thickness and is brittle. A thermoplastic resin can be freely shaped and is lightweight, but has a disadvantage of insufficient rigidity when it is used alone.

SUMMARY OF THE INVENTION

The present invention has been made in view of solving the above-described conventional problems, and an object of the present invention is therefore to provide a speaker diaphragm and a speaker structure each having an excellent balance between rigidity and internal loss.

A speaker diaphragm according to an embodiment of the present invention includes a base material impregnated with a thermosetting resin composition. The base material includes a first surface material, a core material, and a second surface material in the stated order; the first surface material and the second surface material are each formed of a woven fabric or a non-woven fabric; and the core material is formed of a woven fabric or a non-woven fabric each including hollow fine particles.

In one embodiment of the invention, the woven fabric or the non-woven fabric forming the core material is formed of a polyester fiber.

In another embodiment of the invention, the core material is formed of a woven fabric or a non-woven fabric each having the hollow fine particles dispersed in a middle part of the core material in a thickness direction.

In still another embodiment of the invention, the core material has through-holes.

In still another embodiment of the invention, the core material is formed of a woven fabric or a non-woven fabric each including a plurality of cells formed with gaps between one another, and each cell includes the hollow fine particles.

In still another embodiment of the invention, the plurality of cells each have at least one shape of a spherical shape, a cylindrical shape, and a polygonal columnar shape.

In still another embodiment of the invention, the hollow fine particles each have a particle size of 15 to 90 μm.

In still another embodiment of the invention, the hollow fine particles each have a density of 0.03 to 0.06 g/cm$^3$.

In still another embodiment of the invention, the first surface material and the second surface material are each formed of a woven fabric or a non-woven fabric of a high-elastic modulus fiber, a natural fiber, or a regenerated fiber.

In still another embodiment of the invention, the woven fabric has a surface density of 100 to 300 g/m$^2$.

In still another embodiment of the invention, the non-woven fabric has a surface density of 30 to 150 g/m$^2$.

In still another embodiment of the invention, the high-elastic modulus fiber includes at least one fiber of a carbon fiber, a polyester fiber, and an aramid fiber.

In still another embodiment of the invention, the carbon fiber has a filament number of 1,000 to 3,000.

In still another embodiment of the invention, the thermosetting resin composition includes an unsaturated polyester resin.

In still another embodiment of the invention, the base material further includes an intermediate layer between the core material, and the first surface material and/or the second surface material.

In still another embodiment of the invention, the intermediate layer is formed of a woven fabric or a non-woven fabric of a high-elastic modulus fiber or a natural fiber.

According to another aspect of the invention, a speaker structure is provided. The speaker structure includes a base material impregnated with a thermosetting resin composition. The base material includes a first surface material, a core material, and a second surface material in the stated order; the first surface material and the second surface material are each formed of a woven fabric or a non-woven fabric; and the core material is formed of one of a woven fabric and a non-woven fabric each including hollow fine particles.

In one embodiment of the invention, the speaker structure is used for a speaker frame, an enclosure, or a stand.

According to still another aspect of the invention, a speaker is provided. The speaker includes the above-described speaker diaphragm and/or speaker structure.

The present invention can provide a diaphragm having low density and large vibration energy loss by using a core material including hollow fine particles. Meanwhile, through-holes provided in the core material or gaps among cells are filled with an impregnating thermosetting resin. Thus, the thermosetting resin is cured, to thereby form columns of a cured resin product in a thickness direction of the diaphragm. As a result, a diaphragm having excellent rigidity can be obtained. In this way, the speaker diaphragm of the present invention has a good balance between internal loss and rigidity, which is hardly obtained in conventional art.

DESCRIPTION OF THE PREFERRED EMBODIMENTS

Figure 1:
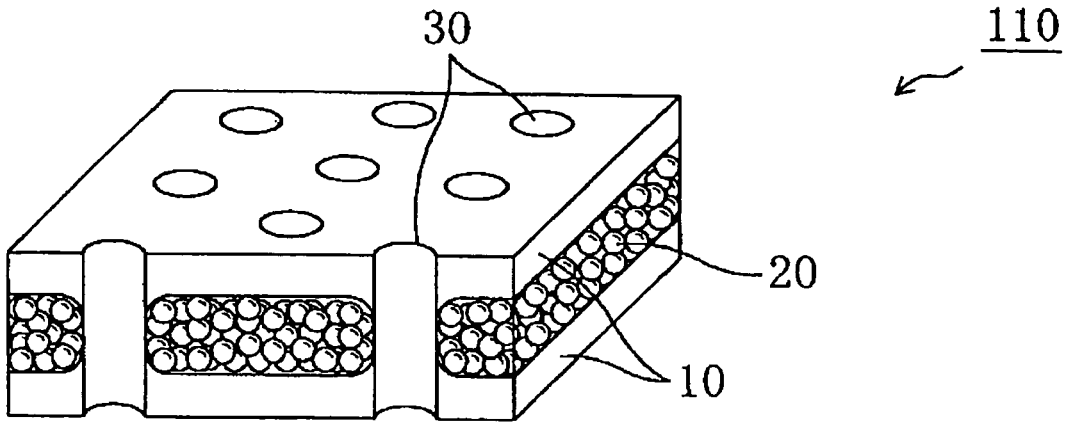
FIG. 1 is a schematic diagram of a core material having through-holes according to a preferred embodiment of the present invention.

A speaker diaphragm of the present invention includes a base material impregnated with a thermosetting resin composition, in which: the base material includes a first surface material, a core material, and a second surface material in the stated order; the first surface material and the second surface material are each formed of a woven fabric or a non-woven fabric; and the core material is formed of a woven fabric or a non-woven fabric each including hollow fine particles. As required, the base material may further include an intermediate layer between the core material and the first surface material and/or the second surface material.

A. Surface Material

A surface material may employ any appropriate woven fabric or non-woven fabric. The surface material may be formed of a monolayer of the woven fabric or non-woven fabric, or may be formed of a laminate of the woven fabric and/or non-woven fabric. The first surface material and the second surface material may be identical to or different from each other. Further, the numbers of the first surface material and second surface material which are laminated may be identical to or different from each other.

In the case where the surface material is formed of a woven fabric, the woven fabric may have any appropriate weave structure (such as a plain weave structure, a twill weave structure, a satin weave structure, or a combination thereof). The woven fabric preferably has a plain weave structure because of excellent mechanical properties in a fiber axis direction of the woven fabric, to thereby allow deep drawing. Thus, the woven fabric having a plain weave structure is particularly preferably used for a cone-shaped diaphragm with a large diameter. A surface density of the woven fabric having a plain weave structure may be selected appropriately in accordance with properties of the fiber to be used (such as mechanical properties, fiber diameter, and fiber length) and the like, and is typically 100 to 300 g/m$^2$ because a surface density within the above range provides a large effect of increasing strength and excellent moldability. Such a surface density includes a weave density of 40 threads/inch in length×40 threads/inch in width, or a weave density of 17 threads/inch in length×17 threads/inch in width, for example.

In the case where the surface material is formed of a non-woven fabric, the non-woven fabric may be formed through any appropriate method. Typical examples of the method of forming a non-woven fabric include: a wet formation method using a fluid such as water; and a dry formation method in which a short fiber is entangled mechanically and randomly. The wet formation method is preferred because anisotropy in mechanical properties can be suppressed and a non-woven fabric with favorable moldability can be obtained. Amass per unit area (surface density) of the non-woven fabric may vary depending on the purpose and is typically 30 to 150 g/m$^2$.

A fiber forming the woven fabric or non-woven fabric to be used for the surface material of the base material may be formed of any appropriate fiber. The fiber forming the woven fabric or non-woven fabric may be formed of a long fiber or a short fiber. Preferred examples thereof include a high-elastic modulus fiber, a natural fiber, and a regenerated fiber. The high-elastic modulus fiber is particularly preferred because a diaphragm having excellent strength can be obtained. Typical examples of the high-elastic modulus fiber include a carbon fiber, a polyester fiber, and an aramid fiber. A particularly preferred example thereof is a carbon fiber.

The high-elastic modulus fiber is preferably a fiber which is not twisted (untwisted fiber). The untwisted fiber may be used to significantly reduce a thickness per unit area, to thereby provide a lightweight diaphragm having excellent strength. Further, such a woven fabric or a non-woven fabric employing the untwisted fiber is used, to thereby reduce drastically an amount of a resin to be impregnated (a ratio of fiber/resin in base material) and significantly improve internal loss.

Any appropriate carbon fiber may be employed as the carbon fiber in accordance with the purpose. The carbon fiber is lightweight and has excellent mechanical properties (such as high specific strength and high specific elastic modulus) and excellent properties (such as heat resistance and small coefficient of thermal expansion) derived from carbon, and is capable of maintaining a favorable structure of the speaker diaphragm. Specific examples of the carbon fiber include a polyacrylonitrile (PAN)-based carbon fiber and a pitch-based carbon fiber. Any appropriate filament number may be selected and is preferably 1,000 to 3,000.

Any appropriate polyester fiber may be employed as the polyester fiber in accordance with the purpose. The polyester fiber has excellent mechanical properties and hardly causes deformation or reduction in elastic modulus due to moisture absorption even after molding. Specific examples of the polyester fiber include polyethylene terephthalate (PET), polybutylene terephthalate (PBT), and polyethylene naphthalate (PEN).

Any appropriate aramid fiber may be employed as the aramid fiber in accordance with the purpose. Specific examples of the aramid fiber include a para-aramid fiber and a meta-aramid fiber. In the case where an aramid fiber is used for the speaker diaphragm, the para-aramid fiber is preferred because of the large internal loss and excellent strength of the fiber.

Any appropriate fiber may be employed as the natural fiber or the regenerated fiber in accordance with the purpose. In particular, the natural fiber is preferred.

The natural fiber is preferably a fiber which is twisted. The natural fiber (such as a cotton fiber or a hemp fiber) has a hollow part inside the fiber and has lower elastic modulus than that of the high-elastic modulus fiber. Thus, the twisted fiber entangles with one another and has higher elastic modulus than that of an untwisted fiber.

The cotton fiber is a thin, flat, and twisted band and has a hollow part. The twist (natural twist) enhances entangling property among fibers and thus increases a Young's modulus. Further, the hollow part increases the internal loss.

The hemp fiber includes a stem fiber and a vein fiber, and has a long fiber length. Jute, which is a stem fiber, is preferably used. The jute includes hollow fibers in bundles and thus has increased internal loss. Further, the jute has a high cellulose content of 50 to 80% and thus has a large Young's modulus. Thus, the hemp fiber may be employed, to thereby provide a speaker diaphragm having a good balance between internal loss and rigidity.

Any appropriate fiber may be employed as the regenerated fiber. Preferred examples thereof include rayon and a cellulose derivative fiber.

B. Core Material

The core material may be formed of any appropriate material. Specific examples thereof include a woven fabric and a non-woven fabric. The core material is preferably formed of the non-woven fabric. The non-woven fabric has fibers dispersed three-dimensionally and randomly and thus is appropriate for including hollow fine particles (described below).

Any appropriate fiber may be employed as a fiber forming the woven fiber or the non-woven fabric. A specific example thereof includes a synthetic fiber. The fiber is preferably a polyester fiber. The polyester fiber has excellent mechanical properties, dimensional stability, durability, heat resistance, and the like. Thus, the polyester fiber may stably include hollow fine particles even after molding of the core material, and deformation or reduction in Young's modulus due to moisture absorption after molding can be suppressed. Further, the polyester fiber has excellent heat resistance and thus can suppress deformation due to heat generated inside a speaker system (such as a coil).

The core material includes hollow fine particles. Preferred modes of the core material including the hollow fine particles include: a mode in which the hollow fine particles are dispersed in a middle part of the core material in a thickness direction; and a mode in which cells each including hollow fine particles are formed in the core material.

FIG. 1 is a schematic diagram explaining an example of a mode in which hollow fine particles are dispersed in a middle part of the core material in a thickness direction. A core material 110 includes: a woven fabric or non-woven fabric 10 forming the entire core material; and hollow fine particles 20 dispersed in a middle part of the core material in a thickness direction. A dispersion density of the hollow fine particles may be appropriately selected in accordance with the purpose. As shown in FIG. 1, the hollow fine particles 20 are typically filled throughout the middle part of the core material. The hollow fine particles are filled throughout the entire middle part of the core material, to thereby form a virtual layer of the hollow fine particles. During vibration of the speaker, the virtual layer and the woven fabric or non-woven fabric 10 shift from each other, and the hollow fine particles themselves shift from one another. As a result, a diaphragm having excellent internal loss can be obtained.

As shown in FIG. 1, the core material preferably has through-holes 30. By forming through-holes, a thermosetting resin permeates into the through-holes and cures during molding of a diaphragm. As a result, columns of a cured resin product are formed in a thickness direction, to thereby provide a diaphragm having excellent rigidity. The number, position to be formed, and shape of the through-holes 30 may be appropriately set in accordance with the purpose. Examples of a shape of each of the through-holes include a polygonal columnar shape, an elliptic cylindrical shape, and a circular cylindrical shape.

Figure 2:
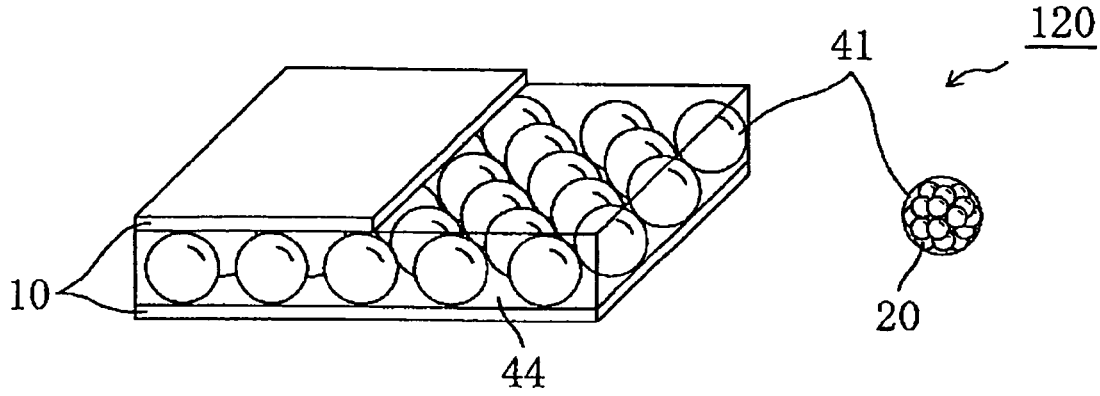
FIG. 2 is a schematic diagram of a core material having spherical cells according to a preferred embodiment of the present invention.
Figure 3:
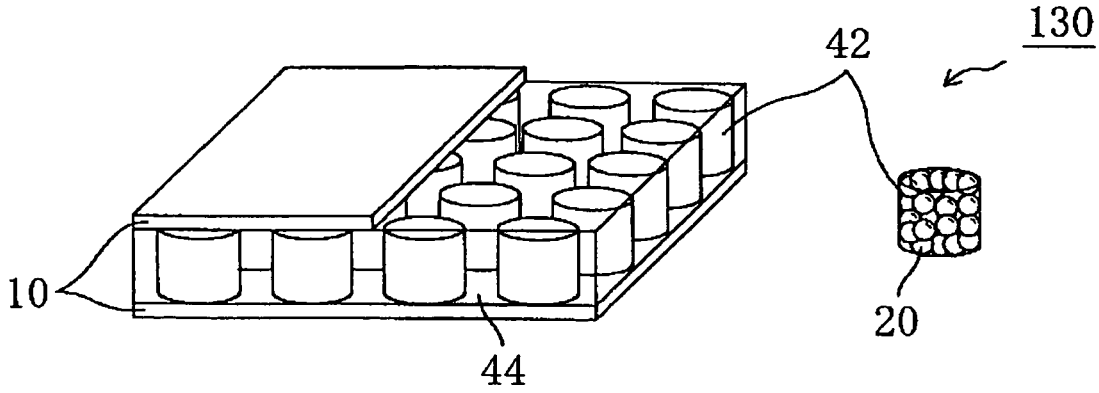
FIG. 3 is a schematic diagram of a core material having cylindrical cells according to a preferred embodiment of the present invention.
Figure 4:
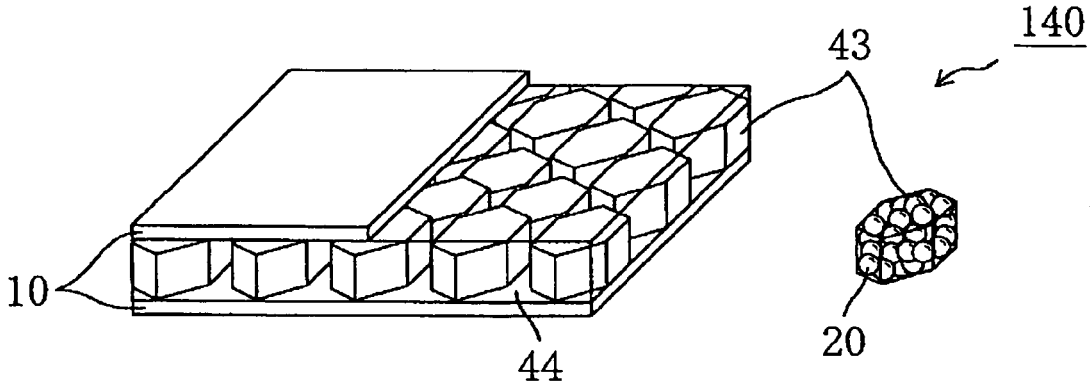
FIG. 4 is a schematic diagram of a core material having polygonal columnar cells according to a preferred embodiment of the present invention.

FIGS. 2 to 4 are each a schematic diagram explaining a typical example of a mode in which cells each including hollow fine particles are formed in the core material. The cells may each have any appropriate shape. Specific examples of the shape of each of the cells include a spherical shape, a cylindrical shape, and a polygonal columnar shape. The cells each preferably have a cylindrical shape or a polygonal columnar shape. FIG. 2 shows the case where the cells each have a spherical shape, and FIG. 3 shows the case where the cells each have a cylindrical shape. FIG. 4 shows the case where the cells each have a hexagonal columnar shape. In FIG. 2, a core material 120 includes: the woven fabric or non-woven fabric 10 forming the entire core material; and spherical cells 41 each including the hollow fine particles 20. In FIG. 3, a core material 130 includes: the woven fabric or non-woven fabric 10 forming the entire core material; and cylindrical cells 42 each including the hollow fine particles 20. In FIG. 4, a core material 140 includes: the woven fabric or non-woven fabric 10 forming the entire core material; and hexagonal columnar cells 43 each including the hollow fine particles 20. In all embodiments, the cells are formed with gaps 44 between one another.

The gaps 44 are formed, to thereby provide a diaphragm having excellent mechanical properties (such as bending property and shear property). This is because the gaps 44 can be selectively impregnated with a thermosetting resin (described below) to be used for molding of the diaphragm, and the thermosetting resin cures, to thereby form walls or columns of the cured resin product in a thickness direction of the diaphragm. The cells may each have an appropriate size in accordance with the purpose. For example, in the case where spherical cells are formed, the cells may each have a diameter of 1.0 to 3.0 mm. The gaps among the cells may also be appropriately set in accordance with the purpose. The size of each of the cells and/or the gaps among the cells (cell forming density) are adjusted, to thereby allow control of the rigidity and internal loss of the diaphragm to be obtained. For example, in the case where hexagonal columnar cells are formed, a side of a hexagon may be set to about 5 mm, and a gap between the cells may be set to about 2.5 mm.

The cells may be formed through any appropriate means as long as the cells may each include the hollow fine particles. For example, the cells may each be formed by dispersing a structure including the hollow fine particles therein during formation of a non-woven fabric or be formed during pressing of a diaphragm. For example, in the case where the cells are each formed during pressing of the diaphragm, an outer part of each of the cells may be identical to the woven fabric or non-woven fabric forming the entire core material.

The hollow fine particles may each have any appropriate particle size in accordance with the purpose. The particle size is preferably 15 to 90 μm, and more preferably 30 to 60 μm. The hollow fine particles each have such a particle size, to thereby increase significantly fluid resistance of a resin composition in the case where a diaphragm is molded by using a thermosetting resin composition (described below). As a result, the thermosetting resin composition is impregnated while the diaphragm has gaps inside, to thereby provide a speaker diaphragm having excellent internal loss. Hollow fine particles each having a specific particle size may be used alone, or hollow fine particles having different particle sizes may be used in combination.

The hollow fine particles may have any appropriate density, and the density is preferably 0.03 to 0.06 g/cm$^3$. A density of less than 0.03 g/cm$^3$ may provide low rigidity and insufficient sound pressure. A density of more than 0.06 g/cm$^3$ may increase a weight of the speaker diaphragm and hardly provides satisfactory acoustic characteristics. Hollow fine particles each having a specific density may be used alone, or hollow fine particle shaving different densities may be used in combination.

C. Intermediate Layer

Any appropriate intermediate layer may be included between the first surface material and the core material, and/or between the second surface material and the core material. The intermediate layer is included, to thereby adjust appropriately a balance between rigidity and internal loss. The intermediate layer is preferably formed of a woven fabric or non-woven fabric because a thermosetting resin composition (described below) must permeate into the core material.

Any appropriate fiber may be employed for the fiber forming the woven fabric or non-woven fabric. The fiber is preferably capable of reducing deformation due to heat during molding of the base material (described below). Further, the fiber preferably has a smaller Young's modulus and larger internal loss than those of the surface materials. Specific examples of the fiber include: a high-elastic modulus fiber such as an aramid fiber; and a natural fiber such as cotton or hemp.

Any appropriate number of intermediate layer may be laminated. Further, a combination of a surface material and an intermediate layer may be selected appropriately in accordance with the purpose. For example, for design of a diaphragm having higher rigidity, specific examples of the combination include: a woven fabric of a carbon fiber/a non-woven fabric of an aramid fiber; a woven fabric of a carbon fiber/a non-woven fabric of a polyester fiber; and a woven fabric of an aramid fiber/a non-woven fabric of an aramid fiber. Meanwhile, for design of a diaphragm having higher internal loss, specific examples of the combination include: a woven fabric of a carbon fiber/a non-woven fabric of a cotton fiber; a woven fabric of a carbon fiber/a non-woven fabric of a jute fiber; and a woven fabric of an aramid fiber/a non-woven fabric of a cotton fiber. Note that those combinations each obviously provide an excellent balance between rigidity and internal loss.

D. Base Material

The base material includes the first surface material, the core material, and the second surface material in the stated order. The base material is impregnated with a thermosetting resin composition. As described above, the base material may include an intermediate layer between the first surface material and the core material and/or between the second surface material and the core material as required.

Any appropriate resin composition may be employed as the thermosetting resin composition. The resin composition preferably contains as a main component an unsaturated polyester resin because such a resin composition has a low cure temperature to suppress modification or degradation of the base material due to heat and has a short cure time to reduce production time compared with that of other thermosetting resin compositions. The thermosetting resin composition may contain various additives as required. Typical examples of the additives include a low profile additive and a curing agent. Examples of the curing agent include an organic peroxide, and a crosslinking agent of a vinyl monomer. Examples of the low profile additive include a thermoplastic resin, and a solution thereof.

Figure 5:
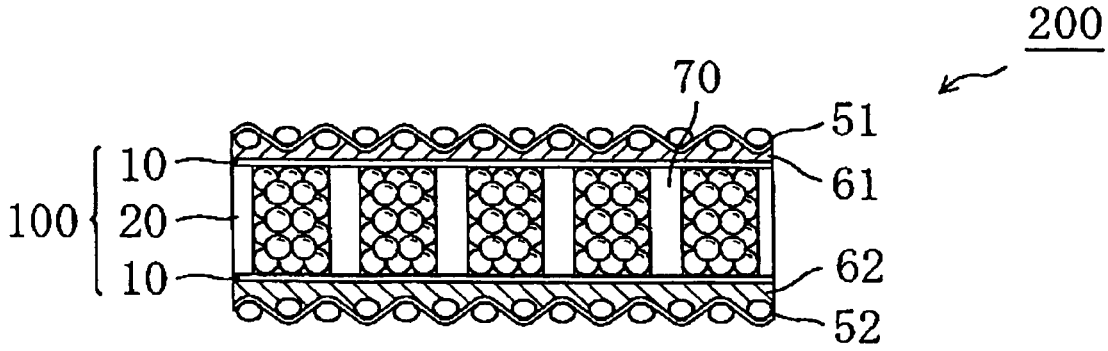
FIG. 5 is a schematic sectional view of a base material according to a preferred embodiment of the present invention.

The speaker diaphragm of the present invention is typically formed by dropping the thermosetting resin composition to the base material, and pressing the whole by using a metal mold having a predetermined shape. The thermosetting resin composition penetrates from the surface material by pressing, and then is filled into the through-holes or gaps each having a small fluid resistance. Meanwhile, a part including the hollow fine particles (a middle part of the core material in thickness direction or a cell) has a significantly large fluid resistance, and the thermosetting resin composition hardly penetrates there into. Thus, the inside of the speaker diaphragm after curing has a structure in which the resin is filled and cured from a clearance of the surface material into the through-holes and/or gaps of the core material. FIG. 5 is a schematic sectional view of a base material according to a preferred embodiment of the present invention. A base material 200 includes a first surface material 51, an intermediate layer 61, a core material 100, an intermediate layer 62, and a second surface material 52. The base material 200 is supported by columns 70 of a resin composition.

According to another aspect of the present invention, a speaker structure is provided. The speaker structure is produced into a predetermined shape by molding the above-mentioned base material. Such a speaker structure may be used for a speaker frame, an enclosure, a stand, or the like.

Hereinafter, the present invention will be described more specifically by using examples, but the present invention is not limited thereto. Note that parts and percents in the examples refer to parts by weight and wt % unless otherwise noted.

EXAMPLE 1

An unsaturated polyester solution having the following composition was prepared:

Unsaturated polyester resin (POLYHOPE N350L; available from Japan Composite Co., LTD.): 100 (parts)

Low profile additive (MODIPER S501; available from NOF Corporation): 5

PEROCTA O (available from NOF Corporation): 1.3

A non-woven fabric of a polyester fiber (Coremat Xi; available from Lantor BV; thickness of 2 mm; surface density of 76 g/m$^2$) including hollow fine particles (particle size of 15 to 90 μm; density of 0.03 to 0.06 g/cm$^3$) dispersed therein was used as a core material. A layer of a woven fabric of a cotton fiber (weave density of 40 threads/inch in length×40 threads/inch in width; surface density of 110 g/cm$^2$; 20 cm square) as a surface material was laminated on each side of the core material. This three-layer laminate was used as a base material.

Two jigs each having a hole with a diameter of about 18 cm in a center part of a stainless steel sheet of about 25 cm square were prepared, and the above-mentioned laminate base material was inserted between the two jigs. About 8 g of the above-mentioned unsaturated polyester solution was dropped onto the vicinity of a center of the base material fixed by the jigs. Then, the whole was molded at 135° C. for 2 minutes by using a matched die having a predetermined shape, to thereby obtain a speaker diaphragm having a diameter of 16 cm and a thickness of 1.45 mm.

The obtained diaphragm was measured for density, weight, Young's modulus, and internal loss (tan δ) through a conventional method. Table 1 collectively shows the obtained results of Example 1, together with the results of Examples 2 to 4 and Comparative Examples 1 and 2 described later. Note that a rigidity ratio was calculated as a ratio of (Young's modulus×(thickness)$^3$) of a diaphragm with respect to (Young's modulus×(thickness)$^3$) of a diaphragm of Comparative Example 1 as 1.0.

EXAMPLE 2

A speaker diaphragm having a diameter of 16 cm and a thickness of 1.53 mm was obtained in the same manner as in Example 1 except that a non-woven fabric of a polyester fiber having spherical cells each including hollow fine particles (Soric TF; available from Lantor BV; thickness of 2 mm; surface density of 130 g/m$^2$) was used as the core material. The obtained diaphragm was subjected to evaluation in the same manner as in Example 1. Table 1 shows the results.

EXAMPLE 3

A speaker diaphragm having a diameter of 16 cm and a thickness of 1.57 mm was obtained in the same manner as in Example 1 except that a non-woven fabric of a polyester fiber having hexagonal columnar cells each including hollow fine particles (Soric XF; available from Lantor BV; thickness of 2 mm; surface density of 140 g/m$^2$) was used as the core material. The obtained diaphragm was subjected to evaluation in the same manner as in Example 1. Table 1 shows the results.

EXAMPLE 4

A speaker diaphragm having a diameter of 16 cm and a thickness of 1.61 mm was obtained in the same manner as in Example 3 except that: a woven fabric of a polyethylene naphthalate (PEN) fiber (weave density of 17 threads/inch in length×17 threads/inch in width; surface density of 160 g/m$^2$; 20 cm square) was used as the first surface material (a surface material on an upper side of the core material); and a non-woven fabric of an aramid fiber (Technora; available from Teijin Ltd.; surface density of 60 g/m$^2$; thickness of 0.65 mm; 20 cm square) was used as the second surface material (a surface material on a lower side of the core material). The obtained diaphragm was subjected to evaluation in the same manner as in Example 1. Table 1 shows the results.

COMPARATIVE EXAMPLE 1

A speaker diaphragm having a diameter of 16 cm and a thickness of 0.21 mm was obtained in the same manner as in Example 1 except that a base material prepared by laminating a woven fabric of a silk fiber (fiber length of 58 mm; surface density of 30 g/m$^2$; thickness of 0.28 mm) and a non-woven fabric of a silk fiber (fiber length of 58 mm; surface density of 40 g/m$^2$; thickness of 0.30 mm) was used. The obtained diaphragm was subjected to evaluation in the same manner as in Example 1. Table 1 shows the results.

COMPARATIVE EXAMPLE 2

A speaker diaphragm having a diameter of 16 cm and a thickness of 0.51 mm was obtained in the same manner as in Example 1 except that a base material prepared by laminating a woven fabric of a PEN fiber (weave density of 17 threads/inch in length×17 threads/inch in width; surface density of 160 g/m$^2$; 20 cm square), a foamed polycarbonate sheet (Miraboard H; available from JSP Corporation; surface density of 360 g/m$^2$; thickness of 3 mm; 20 cm square), and a non-woven fabric of an aramid fiber (Technora; available from Teijin Ltd.; surface density of 60 g/m$^2$; thickness of 0.65 mm; 20 cm square) in the stated order was used. The obtained diaphragm was subjected to evaluation in the same manner as in Example 1. Table 1 shows the results.

TABLE 1

| | Young's modulus [dyne/cm$^2$] | Density [g/cm$^3$] | Tan δ | Thickness [mm] | Rigidity ratio |
|---|---|---|---|---|---|
| Example 1 | $2.01 \times 10^{10}$ | 0.88 | 0.041 | 1.45 | 161.38 |
| Example 2 | $2.47 \times 10^{10}$ | 0.85 | 0.053 | 1.53 | 232.97 |
| Example 3 | $2.55 \times 10^{10}$ | 0.84 | 0.067 | 1.57 | 239.88 |
| Example 4 | $2.85 \times 10^{10}$ | 0.76 | 0.073 | 1.67 | 349.58 |
| Comparative Example 1 | $4.10 \times 10^{10}$ | 1.22 | 0.028 | 0.21 | 1.00 |
| Comparative Example 2 | $1.44 \times 10^{10}$ | 0.58 | 0.031 | 0.51 | 5.03 |

EXAMPLE 5

The non-woven fabric of polyester of Example 3 was used as the core material. A woven fabric of a PEN fiber (weave density of 17 threads/inch in length×17 threads/inch in width; surface density of 160 g/m$^2$; 20 cm square) was arranged on an upper side of the core material, and a woven fabric of a jute fiber (weave density of 8 threads/inch in length×44 threads/inch in width; surface density of 260 g/m$^2$; 20 cm square) and a non-woven fabric of an aramid fiber (Technora; available from Teijin Ltd.; surface density of 60 g/m$^2$; thickness of 0.65 mm; 20 cm square) were arranged on a lower side of the core material, to thereby form a four-layer laminate base material. Further, the base material was molded in the same manner as in Example 1 except that 10 g of the unsaturated polyester solution was used, to thereby obtain a speaker diaphragm having a diameter of 16 cm and a thickness of 1.96 mm. The obtained diaphragm was subjected to evaluation in the same manner as in Example 1. Table 2 shows the results. Note that a rigidity ratio was calculated as a ratio of (Young's modulus×(thickness)$^3$) of a diaphragm with respect to (Young's modulus×(thickness)$^3$) of a diaphragm of Comparative Example 3 as 1.0.

EXAMPLE 6

A speaker diaphragm having a diameter of 16 cm and a thickness of 2.13 mm was obtained in the same manner as in Example 5 except that a woven fabric of a jute fiber (weave density of 8 threads/inch in length×44 threads/inch in width; surface density of 260 g/m$^2$; 20 cm square) was further laminated between the woven fabric of a PEN fiber and the core material. The obtained diaphragm was subjected to evaluation in the same manner as in Example 1. Table 2 shows the results.

COMPARATIVE EXAMPLE 3

A speaker diaphragm having a diameter of 16 cm and a thickness of 0.51 mm was obtained in the same manner as in Example 1 except that a base material prepared by laminating a woven fabric of a PEN fiber (weave density of 17 threads/inch in length×17 threads/inch in width; surface density of 160 g/m$^2$; 20 cm square), a foamed polycarbonate sheet (Miraboard H; available from JSP Corporation; surface density of 360 g/m$^2$; thickness of 3 mm; 20 cm square), and a non-woven fabric of an aramid fiber (Technora; available from Teijin Ltd.; surface density of 60 g/m$^2$; thickness of 0.65 mm; 20 cm square) in the stated order was used. The obtained diaphragm was subjected to evaluation in the same manner as in Example 1. Table 2 shows the results.

COMPARATIVE EXAMPLE 4

A speaker diaphragm having a diameter of 16 cm and a thickness of 1.73 mm was obtained in the same manner as in Example 1 except that five layers of a woven fabric of a jute fiber (weave density of 8 threads/inch in length×44 threads/inch in width; surface density of 260 g/m$^2$; 20 cm square) were laminated to form a base material. The obtained diaphragm was subjected to evaluation in the same manner as in Example 1. Table 2 shows the results.

TABLE 2

| | Young's modulus [dyne/cm$^2$] | Density [g/cm$^3$] | Tan δ | Thickness [mm] | Rigidity ratio |
|---|---|---|---|---|---|
| Example 5 | $4.25 \times 10^{10}$ | 0.79 | 0.079 | 1.96 | 167.52 |
| Example 6 | $5.65 \times 10^{10}$ | 0.81 | 0.076 | 2.13 | 286.15 |
| Comparative Example 3 | $1.44 \times 10^{10}$ | 0.58 | 0.031 | 0.51 | 1.00 |
| Comparative Example 4 | $4.71 \times 10^{10}$ | 1.25 | 0.046 | 1.73 | 127.63 |

EXAMPLE 7

A woven fabric of a carbon fiber (Torayca Cloth C06343; available from Toray Industries, Inc.; plain weave; weave density of 12.5 threads/inch in length×12.5 threads/inch in width; surface density of 198 g/m$^2$; thickness of 0.25 mm) as a surface material was laminated on each side of the core material of Example 3, to thereby form a base material having a three-layer structure. Two jigs each having a hole with a diameter of about 18 cm in a center part of a stainless steel sheet of about 25 cm square were prepared, and the above-mentioned laminate was inserted between the two jigs. About 8 g of the unsaturated polyester solution prepared in the same manner as in Example 1 was dropped to the vicinity of a center of the base material fixed by the jigs. Then, the whole was molded at 135° C. for 2 minutes by using a matched die having a predetermined shape and cured in a temperature-controlled bath at 80° C. for about 1 hour, to thereby obtain a speaker frame having a diameter of about 20 cm and a thickness of 2.16 mm. The obtained speaker frame was subjected to evaluation in the same manner as in Example 1. Table 3 shows the results. Note that a rigidity ratio was calculated as a ratio of (Young's modulus×(thickness)$^3$) of a speaker frame with respect to (Young's modulus×(thickness)$^3$) of a speaker frame of Comparative Example 6 as 1.0.

EXAMPLE 8

A speaker frame having a diameter of about 20 cm and a thickness of 2.00 mm was obtained in the same manner as in Example 7 except that the woven fabric of a carbon fiber on lower side of the core material in the base material of Example 7 was changed to a woven fabric of an aramid fiber (KEVLAR; available from DuPont-Toray Co., Ltd.; plain weave; weave density of 12.5 threads/inch in length×12.5 threads/inch in width; surface density of 110 g/m$^2$; thickness of 0.26 mm). The obtained frame was subjected to evaluation in the same manner as in Example 1. Table 3 shows the results.

COMPARATIVE EXAMPLE 5

Three layers of a woven fabric of a carbon fiber (Torayca Cloth C06343; available from Toray Industries, Inc.; plain weave; weave density of 12.5 threads/inch in length×12.5 threads/inch in width; surface density of 198 g/m$^2$; thickness of 0.25 mm; 20 cm square) were laminated, to thereby obtain a base material. A speaker frame having a diameter of 20 cm and a thickness of 0.64 mm was obtained in the same manner as in Example 7 except that this base material was used. The obtained frame was subjected to evaluation in the same manner as in Example 1. Table 3 shows the results.

COMPARATIVE EXAMPLE 6

A speaker frame having a diameter of 20 cm and a thickness of 0.54 mm was obtained in the same manner as in Comparative Example 5 except that the woven fabric of a carbon fiber was changed to a woven fabric of an aramid fiber (KEVLAR; available from DuPont-Toray Co., Ltd.; plain weave; weave density of 12.5 threads/inch in length× 12.5 threads/inch in width; surface density of 110 g/m$^2$; thickness of 0.26 mm). The obtained speaker frame was subjected to evaluation in the same manner as in Example 1. Table 3 shows the results.

COMPARATIVE EXAMPLE 7

A cold-rolled steel sheet (SPCC material; thickness of 0.8 mm) was cold pressed by using a press metal mold, to thereby obtain a speaker frame having a diameter of 20 cm and a thickness of 0.8 mm. The obtained speaker frame was subjected to evaluation in the same manner as in Example 1. Table 3 shows the results.

COMPARATIVE EXAMPLE 8

An ABS resin (Toyolac 885VG30/30% glass fiber; available from Toray Industries, Inc.) was molded into a shape of a speaker frame through injection molding (thickness of 2.0 mm). The obtained speaker frame was subjected to evaluation in the same manner as in Example 1. Table 3 shows the results.

TABLE 3

| | Young's modulus [dyne/cm$^2$] | Density [g/cm$^3$] | Tan δ | Thickness [mm] | Rigidity ratio |
|---|---|---|---|---|---|
| Example 7 | $1.10 \times 10^{11}$ | 0.62 | 0.045 | 2.16 | 74.9 |
| Example 8 | $9.53 \times 10^{11}$ | 0.60 | 0.047 | 2.00 | 51.5 |
| Comparative Example 5 | $1.94 \times 10^{11}$ | 1.39 | 0.020 | 0.64 | 3.4 |
| Comparative Example 6 | $9.37 \times 10^{10}$ | 1.26 | 0.040 | 0.54 | 1.0 |
| Comparative Example 7 | $2.05 \times 10^{12}$ | 7.90 | 0.019 | 0.80 | 70.90 |
| Comparative Example 8 | $1.90 \times 10^{10}$ | 1.25 | 0.050 | 2.00 | 10.3 |

EXAMPLE 9

The non-woven fabric of polyester of Example 1 was used as the core material. A non-woven fabric of an aramid fiber (Technora; available from Teijin Ltd.; fiber length of 58 mm; surface density of 60 g/m$^2$; thickness of 0.4 mm; 20 cm square) as a first intermediate layer or a second intermediate layer was arranged on each side of the core material. Then, a woven fabric of a carbon fiber (Torayca Cloth C06142; available from Toray Industries, Inc.; 1,000 filaments; plain weave; weave density of 22.5 threads/inch in length×22.5 threads/inch in width; surface density of 119 g/m$^2$; thickness of 0.15 mm; 20 cm square) as a first surface material or a second surface material was laminated on a side of each intermediate layer, to thereby form a base material. A speaker diaphragm having a diameter of 16 cm and a thickness of 1.542 mm was obtained in the same manner as in Example 1 except that this base material was used. The obtained diaphragm was subjected to evaluation in the same manner as in Example 1. Table 4 shows the results. Note that a rigidity ratio was calculated as a ratio of (Young's modulus×(thickness)$^3$) of a diaphragm with respect to (Young's modulus×(thickness)$^3$) of a diaphragm of Comparative Example 1 as 1.0. Table 4 collectively shows the results of Example 9 together with the results of Examples 10 to 14 described below. Further, Table 4 shows the results of Comparative Examples 1 and 2 again.

EXAMPLE 10

A speaker diaphragm having a diameter of 16 cm and a thickness of 1.599 mm was obtained in the same manner as in Example 9 except that the woven fabric of a carbon fiber in Example 9 was changed to a woven fabric of a carbon fiber (Torayca Cloth C06343; available from Toray Industries, Inc.; 3,000 filaments; plain weave; weave density of 12.5 threads/inch in length×12.5 threads/inch in width; surface density of 198 g/m$^2$; thickness of 0.25 mm; 20 cm square). The obtained diaphragm was subjected to evaluation in the same manner as in Example 1. Table 4 shows the results.

EXAMPLE 11

A speaker diaphragm having a diameter of 16 cm and a thickness of 1.602 mm was obtained in the same manner as in Example 9 except that the first intermediate layer and the second intermediate layer were each changed to a non-woven fabric of cotton (surface density of 40 g/m$^2$; thickness of 0.30 mm). The obtained diaphragm was subjected to evaluation in the same manner as in Example 1. Table 4 shows the results.

EXAMPLE 12

A speaker diaphragm having a diameter of 16 cm and a thickness of 1.539 mm was obtained in the same manner as in Example 11 except that the non-woven fabric of cotton was used for the first intermediate layer (intermediate layer on an upper side of the core material) alone. The obtained diaphragm was subjected to evaluation in the same manner as in Example 1. Table 4 shows the results.

EXAMPLE 13

A speaker diaphragm having a diameter of 16 cm and a thickness of 1.587 mm was obtained in the same manner as in Example 9 except that the intermediate layers were omitted. The obtained diaphragm was subjected to evaluation in the same manner as in Example 1. Table 4 shows the results.

EXAMPLE 14

The non-woven fabric of polyester of Example 2 was used as the core material, and a non-woven fabric of cotton (surface density of 40 g/m$^2$; thickness of 0.30 mm) as a first intermediate layer was arranged on an upper surface of the core material. A woven fabric of a PEN fiber (available from Teijin Ltd.; weave density of 17 threads/inch in length×17 threads/inch in width; surface density of 166 g/m$^2$; 20 cm square) as a first surface material was laminated on an upper surface of the first intermediate layer, and the non-woven fabric of an aramid fiber of Example 9 as a second surface material was laminated on lower surface of the core material, to thereby form a base material. A speaker diaphragm having a diameter of 16 cm and a thickness of 1.630 mm was obtained in the same manner as in Example 1 except that this base material was used. The obtained diaphragm was subjected to evaluation in the same manner as in Example 1. Table 4 shows the results.

TABLE 4

| | Young's modulus [dyne/cm$^2$] | Density [g/cm$^3$] | Tan δ | Thickness [mm] | Rigidity ratio |
|---|---|---|---|---|---|
| Example 9 | $1.30 \times 10^{11}$ | 0.713 | 0.089 | 1.542 | 1255 |
| Example 10 | $1.71 \times 10^{11}$ | 0.770 | 0.084 | 1.599 | 1841 |
| Example 11 | $1.23 \times 10^{11}$ | 0.615 | 0.077 | 1.602 | 1331 |
| Example 12 | $1.34 \times 10^{11}$ | 0.538 | 0.093 | 1.539 | 1286 |
| Example 13 | $1.19 \times 10^{11}$ | 0.450 | 0.069 | 1.587 | 1252 |
| Example 14 | $6.00 \times 10^{10}$ | 0.760 | 0.021 | 1.630 | 672 |
| Comparative Example 1 | $4.10 \times 10^{10}$ | 1.220 | 0.028 | 0.21 | 1 |
| Comparative Example 2 | $1.44 \times 10^{10}$ | 0.580 | 0.031 | 0.51 | 5 |

Table 1 clearly shows that the diaphragm of each of Examples 1 to 4 including the hollow fine particles in the core material has excellent internal loss and rigidity ratio compared with those of the diaphragm of each of Comparative Examples 1 and 2. In addition, the results of Examples 1 to 3 reveal that the internal loss and Young's modulus improve further by forming cells each including the hollow fine particles. The results of Example 4 reveal that the internal loss and Young's modulus improve furthermore by using a high-elastic modulus fiber such as a polyester fiber and/or an aramid fiber for the surface material.

Table 2 and the results of Example 4 (described in Table 1) clearly show that a hollow woven fabric of a natural fiber having high elastic modulus is laminated on an upper side and/or a lower side of the core material including the hollow fine particles, to thereby provide a diaphragm having excellent internal loss compared with that of a diaphragm having no woven fabric of a natural fiber laminated. Further, a woven fabric and/or non-woven fabric of a high-elastic modulus fiber is laminated on the surface of the woven fabric of a natural fiber, to thereby provide a diaphragm also having excellent Young's modulus.

Table 3 clearly shows that the speaker structure of each of Example 7 and 8 has excellent rigidity ratio and internal loss compared with those of the speaker structure of each of Comparative Example 5 to 8. Further, the structure of each of Examples has a low density and thus contributes to weight reduction. The speaker structure of Comparative Example 7 has excellent rigidity but has internal loss of ½ or less of that of the speaker structure of each of Examples, and reverberant sound specific to the material tends to remain. Further, the speaker structure of Comparative Example 7 has a significantly high density, and thus is not a preferred speaker structure. The speaker structure of Comparative Example 8 has large internal loss but significantly low rigidity. The speaker structure of Comparative Example 8 has a density of twice or more of that of the speaker structure of each of Examples, and thus is not a preferred speaker structure.

Table 4 clearly shows that at least one intermediate layer is included, to thereby provide speaker diaphragm having a good balance between Young's modulus and internal loss. The results reveal that inclusion of an intermediate layer allows reduction in density and provides a good balance between Young's modulus and internal loss.

As described above, the present invention can provide speaker diaphragm having excellent Young's modulus and internal loss and a lightweight speaker having excellent rigidity by filling the hollow fine particles into the core material and impregnating the base material with the thermosetting resin composition.

Many other modifications will be apparent to and be readily practiced by those skilled in the art without departing from the scope and spirit of the invention. It should therefore be understood that the scope of the appended claims is not intended to be limited by the details of the description but should rather be broadly construed.

What is claimed is:

1. A speaker diaphragm comprising a base material impregnated with a thermosetting resin composition, wherein:

the base material comprises a first surface material, a core material, and a second surface material in the stated order;

the first surface material and the second surface material are each formed of a woven fabric or non-woven fabric, which does not include hollow fine particles;

the core material is formed of a woven fabric or non-woven fabric, including hollow fine particles.

2. A speaker diaphragm according to claim 1, wherein one of the woven fabric and the non-woven fabric forming the core material is formed of a polyester fiber.

3. A speaker diaphragm according to claim 1, wherein the core material is formed of one of a woven fabric and a non-woven fabric each having the hollow fine particles dispersed in a middle part of the core material in a thickness direction.

4. A speaker diaphragm according to claim 3, wherein the core material has through-holes.

5. A speaker diaphragm according to claim 1, wherein the core material is formed of one of a woven fabric and a non-woven fabric each including a plurality of cells formed with gaps between one another, and each cell including the hollow fine particles.

6. A speaker diaphragm according to claim 5, wherein the plurality of cells each have at least one shape selected from the group consisting of a spherical shape, a cylindrical shape, and a polygonal columnar shape.

7. A speaker diaphragm according to claim 1, wherein the hollow fine particles each have a particle size of 15 to 90 μm.

8. A speaker diaphragm according to claim 1, wherein the hollow fine pan ides each have a density of 0.03 to 0.06 g/cm$^3$.

9. A speaker diaphragm according to claim 1, wherein the first surface material and the second surface material are each formed of one of a woven fabric and a non-woven fabric of a fiber selected from the group consisting of a high-elastic modulus fiber, a natural fiber, and a regenerated fiber.

10. A speaker diaphragm according to claim 9, wherein the woven fabric has a surface density of 100 to 300 $g/m^2$.

11. A speaker diaphragm according to claim 9, wherein the non-woven fabric has a surface density of 30 to 150 $g/m^2$.

12. A speaker diaphragm according to claim 9, wherein the high-elastic modulus fiber comprises at least one fiber selected from the group consisting of a carbon fiber, a polyester fiber, and an aramid fiber.

13. A speaker diaphragm according to claim 12, wherein the carbon fiber has a filament number of 1,000 to 3,000.

14. A speaker diaphragm according to claim 1, wherein the thermosetting resin composition comprises an unsaturated polyester resin.

15. A speaker diaphragm according to claim 14, wherein the base material further comprises an intermediate layer between the core material, and at least one of the first surface material and the second surface material.

16. A speaker diaphragm according to claim 15, wherein the intermediate layer is formed of one of a woven fabric and a non-woven fabric of one of a high-elastic modulus fiber and a natural fiber.

17. A speaker diaphragm according to claim 1, which is used for one selected from the group consisting of a speaker frame, an enclosure, and a stand.

* * * * *

UNITED STATES PATENT AND TRADEMARK OFFICE

CERTIFICATE OF CORRECTION

PATENT NO. : 7,344,001 B2
APPLICATION NO. : 11/355438
DATED : March 18, 2008
INVENTOR(S) : Inoue et al.

It is certified that error appears in the above-identified patent and that said Letters Patent is hereby corrected as shown below:

Column 16, Line 60, Claim 8, "pan ides" should read
-- particles --

Signed and Sealed this

Fifth Day of August, 2008

JON W. DUDAS
*Director of the United States Patent and Trademark Office*